United States Patent [19]

Bonham

[11] 3,980,090

[45] Sept. 14, 1976

[54] HAIR SEIZURE AND IMPLANTATION METHOD

[76] Inventor: David C. Bonham, 3594 S. 3610 East, Salt Lake City, Utah 84109

[22] Filed: Sept. 25, 1974

[21] Appl. No.: 509,250

[52] U.S. Cl. ..... 132/5; 132/53; 112/79 R; 46/172

[51] Int. Cl.[2] ..... A41G 3/00; D05C 15/02

[58] Field of Search ..... 112/266, 262, 79 R, 112/79.5, 170; 223/99; 156/148, 72, 68; 161/67, 66; 132/5, 53, 54, 56; 46/172

[56] References Cited

UNITED STATES PATENTS

| | | | |
|---|---|---|---|
| 736,412 | 8/1903 | Lewin | 161/66 |
| 2,253,635 | 8/1941 | Mann | 132/56 |
| 2,636,460 | 4/1953 | Seiderman | 112/79.5 X |
| 2,645,057 | 7/1953 | Napolitan | 132/53 X |
| 3,217,676 | 11/1965 | Short | 112/79 R |
| 3,289,902 | 12/1966 | Fritts | 223/99 |
| 3,513,860 | 5/1970 | Kost | 132/56 X |
| 3,589,376 | 6/1971 | Kohler | 132/53 X |
| 3,756,879 | 9/1973 | Bonham | 156/72 |

*Primary Examiner*—H. Hampton Hunter
*Attorney, Agent, or Firm*—Criddle, Thorpe & Western

[57] ABSTRACT

A method of seizing and implanting fiber in a base includes the steps of positioning a number of fibers together, moving a hollow needle into contact with the fiber ends so that a fiber end is received into the hollow of the needle, and inserting the needle into the base to implant therein the fiber carried by the needle.

5 Claims, 1 Drawing Figure

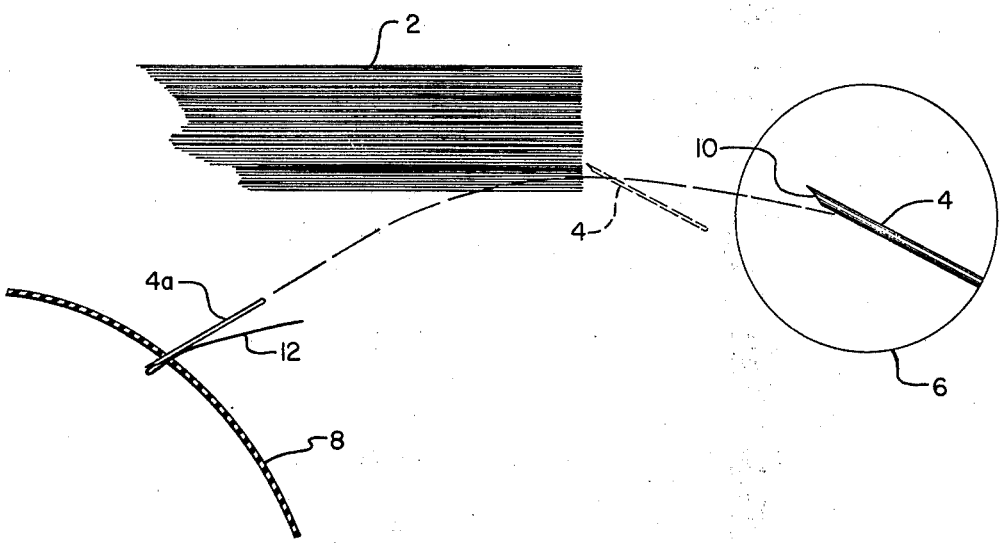
2
10
4
4
4a
12
6
8

HAIR SEIZURE AND IMPLANTATION METHOD

BACKGROUND OF THE INVENTION

This invention relates to a method of seizing fibers for subsequent disposition thereof.

The present invention, although applicable to seizure and implantation of any type of fiber, was born out of a search for a more efficient method of constructing hairpieces. Hairpieces are becoming increasingly popular but one deterrent to possibly an even more widespread acceptance is their high cost due partly to the hand labor generally required in the making of the hairpieces. The hand labor methods most often used in the past have involved inserting hairs through a mesh backing material and then tying the hairs to hold them in place. It is apparent that with these methods, the construction of a hairpiece would be time consuming and therefor costly.

A number of new methods and materials have been suggested for reducing the amount of hand labor required and for producing a more natural looking hairpiece. See, for example, my U.S. Pat. Nos. 3,660,185 and 3,756,879. The objective of these new methods is to reduce the cost of hairpiece construction so that hairpieces may be more readily available to a larger population of users.

SUMMARY OF THE INVENTION

It is an object of the present invention to provide a new and improved method of seizing fibers.

It is also an object of the present invention, in accordance with one aspect thereof, to provide a fiber implantation method which uses simple, inexpensive and readily available materials and equipment.

It is still another object of the present invention, in accordance with another aspect thereof, to provide a fiber implantation method in which a single fiber may be accurately and rapidly implanted in a base.

The above and other objects and advantages of the present invention are realized in an illustrative method of seizing fibers, in which a needle having an opening in one end thereof is moved into contact with the end of the fiber so that the fiber end is received into the opening. In a specific embodiment of the method of the inventor, the needle, with the seized fiber, is inserted into a base to implant therein the fiber carried by the needle.

BRIEF DESCRIPTION OF THE DRAWING

The above and other objects, features and advantages of the present invention will become more apparent from a consideration of the following detailed description of a specific illustrative embodiment presented in connection with the accompanying drawing which illustrates a method of hair implantation carried out in accordance with the principles of the present invention.

DETAILED DESCRIPTION

Although the present invention is applicable to seizure and implantation of any type of fiber in a suitable base, a specific embodiment for seizing and implanting hair in a scalp base will be described.

Shown in the drawing is a bundle of hairs 2 which are to be seized by a needle 4 (shown magnified in the circle 6) for implantation in an artificial scalp base 8. The hairs of the bundle 2 are positioned or grouped together so that one end of each hair in the bundle terminates generally in the same plane as the corresponding ends of the other hairs. Advantageously, the bundle of hairs 2 is positioned or held near the scalp base 8 for reasons that will become apparent as the hair implantation method is described.

The scalp base 8 might illustratively be constructed of silicone rubber or other rubbery material in accordance with the method described in U.S. Pat. No. 3,756,879. Such a material provides a durable and natural-looking hairpiece base, while also facilitating the implantation method of the present invention.

The needle 4 used in the method of the present invention is hollow in one end 10 and is beveled similar to a standard hypodermic needle. The dimensions of the hollow of the needle 4 are preferably selected so that the hollow may receive only a single hair. To do this, the dimensions should be just slightly larger than the diameter of the hairs to be implanted.

The method and process for seizing and implanting hair in accordance with the present invention involves moving the needle in a direction so that the beveled end thereof contacts the hair ends and at least one hair is received into the hollow of the needle. As the needle is moved into contact with the hair ends, along a path substantially as shown by the dashed line in the drawing, the end of one of the hairs of the bundle 2 is forced into the hollow of the needle. The needle (carrying the hair) is then moved on through the bundle 2 and is inserted into the scalp base 8 to force the hair end through the scalp base. A needle **4*a* is shown with a hair 12 inserted through the scalp base 8.** When the needle is removed from the scalp base, the contact of the rubbery scalp base with the hair prevents the hair from being pulled out of the scalp base and the hair is left planted in the scalp base.

It has been found that if the needle is moved so that the plane of the beveled end approaches the hair ends along an arced path as generally illustrated by the dashed line in the drawing, a hair is more readily seized. That is, if the needle approaches the hair ends so that the exposed area of the needle hollow presented to the hair ends is fairly large, a hair end is more readily received into the hollow. Of course, the more nearly normal the plane of the bevel approaches the hair ends, the larger is the exposed area of the hollow presented to the hair ends. By then moving the needle on through the hair bundle 2 along the path illustrated in the drawing, the hair carried by the needle is bent and thereby binds against the walls of the hollow of the needle so that it remains within the hollow until implanted.

It is apparent that with the above described method, hair may be seized and implanted by a person manually holding the needle or by automated equipment arranged to hold and move the needle. The method enables the seizure and implantation of a single hair at a location in the scalp base which can be precisely selected. Furthermore, the hair ends can be rapidly seized by the needle for later implantation.

It is also apparent that the hollow needle may be used simply for seizing individual hairs or other fibers for whatever purpose the user may have. Thus, if it is desired to select a single hair from a bundle of hairs, the above-described method could be employed.

Also, although the needle employed in the method described above included a hollow extending longitudinally within the needle, a needle having an opening extending transversely therethrough could also be used. In such case, the needle would be moved toward the hair ends so as to expose as much of the area of the opening to the hair as is necessary to effect seizure.

It is to be understood that the above-described process is only illustrative of the application of the principles of the present invention. Numerous modifications in the process may be devised by those skilled in the art without departing from the spirit and scope of the invention and the appended claims are intended to cover such modifications.

What is claimed is:

1. A process of implanting hair in a scalp base comprising moving a needle having an axially extending opening in one end thereof into contact with the end of a hair so that the hair end is received longitudinally into the opening and a portion of the hair extends out of the opening, moving the needle so that the hair end remains therein, inserting said one end of the needle into the scalp base to implant the hair therein, and removing the needle from the scalp base to leave the hair implanted therein.

2. A process as in claim 1 wherein the opening in the needle extends within the shank of the needle from said one end toward the other end to form a hollow in the needle.

3. A process as in claim 2 wherein said one end of the needle is beveled.

4. A process as in claim 3 wherein the needle is moved in an arc to contact and receive the hair end.

5. A method of seizing a hair comprising moving a needle, having a bore extending axially through an end and into the needle shank, into contact with the hair end generally from the direction in which the hair end points, the end of said needle having said bore approaching the hair end so that a portion of the hair is received longitudinally into the bore thereby enabling the needle to carry the hair.

* * * * *